United States Patent [19]

Naumann et al.

[11] 4,324,965

[45] Apr. 13, 1982

[54] MICROWAVE HEATING METHOD AND APPARATUS INCLUDING ADJUSTABLE TUNING MEMBERS

[75] Inventors: Gerd Naumann; Bernd Treine, both of Hannover, Fed. Rep. of Germany

[73] Assignee: Hermann Berstorff Maschinenbau GmbH, An der Breiten Wiese, Fed. Rep. of Germany

[21] Appl. No.: 97,656

[22] Filed: Nov. 27, 1979

Related U.S. Application Data

[63] Continuation-in-part of Ser. No. 60,365, Jul. 25, 1979, abandoned.

[51] Int. Cl.[3] ..... H05B 6/70

[52] U.S. Cl. ..... 219/10.55 F; 219/10.55 A; 219/10.55 M

[58] Field of Search ..... 219/10.55 A, 10.55 F, 219/10.55 R

[56] References Cited

U.S. PATENT DOCUMENTS

| | | | |
|---|---|---|---|
| 3,413,433 | 11/1968 | Timmermans et al. | 219/10.55 A X |
| 3,757,070 | 9/1973 | Van Koughnett et al. | 219/10.55 F |
| 3,764,768 | 10/1973 | Sayer, Jr. | 219/10.55 A |
| 4,093,840 | 6/1978 | Jean et al. | 219/10.55 A |
| 4,099,042 | 7/1978 | Jean et al. | 219/10.55 A |
| 4,179,595 | 12/1979 | Ciron | 219/10.55 A |
| 4,198,554 | 4/1980 | Wayne | 219/10.55 F X |

FOREIGN PATENT DOCUMENTS

| | | | |
|---|---|---|---|
| 2642336 | 1/1978 | Fed. Rep. of Germany | 219/10.55 F |
| 2642335 | 4/1978 | Fed. Rep. of Germany | 219/10.55 F |

*Primary Examiner*—Arthur T. Grimley

*Attorney, Agent, or Firm*—Schwartz, Jeffery, Schwaab, Mack, Blumenthal & Koch

[57] ABSTRACT

A method and apparatus for matching a microwave heater to reduce the microwave energy reflected by the load, wherein microwave energy from a microwave energy source is supplied to a treatment chamber by a hollow waveguide of rectangular section. A directional coupler in the waveguide prevents reflected energy returning to the source and directs it to absorption means. A detector is provided at the absorption means to measure the reflected energy and produce a signal, and control means is provided to operate control motors to operate tuning pins provided in the waveguide, the control motors having different operating speeds.

4 Claims, 3 Drawing Figures

MICROWAVE HEATING METHOD AND APPARATUS INCLUDING ADJUSTABLE TUNING MEMBERS

CROSS-REFERENCE TO RELATED APPLICATION

The present application is a continuation-in-part of our earlier filed application Ser. No. 60,365, filed July 25, 1979, and now abandoned.

BACKGROUND OF THE INVENTION

The invention relates to a method and apparatus for dielectric heating by means of microwave energy.

It is known that, in order to achieve a high degree of efficiency for a microwave heater, the load must be matched to the microwave generator and its waveguide, as the microwave generator, the energy waveguide, the treatment chamber and the load may have different impedances. If the impedances of the microwave generator, the waveguide and the treatment chamber on the one hand and the impedance of the load on the other hand are different, transformation means must be interposed between them, the purpose of the transformation means being to match the impedance of the load to the impedance of the microwave generator with the wave guide and the treatment chamber. Optimum utilization of the microwave energy is ensured only when the entire quantity of energy produced in the microwave generator is converted to heat in the load. This means that as far as possible, there should not be any reflection of the microwave energy at the load.

In order to provide for low-reflection matching of the load, it has been proposed to provide one or more tuning pins or tuning screws to project displaceably into the waveguide, which waveguide may be in the form of a hollow waveguide passage. With such tuning members which act as a matching transformer, it is theoretically possible for any load impedance to be matched to any generator impedance.

It has been found that the impedance of the load is variable, in operation of a microwave heater. Therefore, it is not sufficient for the load to be matched just once to the microwave generator by way of the tuning members. There is therefore a requirement for automatic matching of the microwave heater during operation thereof. This automatic matching operation is intended to reduce to a minimum the amount of microwave energy which is reflected by the load, as a result of defective matching.

It has already been proposed that the microwave energy reflected by the load may be measured and the tuning members adjusted in accordance with the measured value, in order to reduce to a minimum the microwave energy which is reflected by the load. However, it is not possible to give a clear adjustment instruction, over a large range of variation of the reflection coefficient.

SUMMARY OF THE INVENTION

The invention is based on the problem of providing a method of matching a microwave heater, which is distinguished by a wide tuning range and extremely precise matching of the load to the microwave generator.

According to one aspect of the invention, there is provided a method of matching a microwave heater, for the purposes of reducing microwave energy reflected by the load wherein microwave energy is supplied to a treatment chamber from a microwave energy source by way of a hollow waveguide of substantially square or rectangular cross-section and matching is effected by means of adjustable tuning members which are disposed in the hollow waveguide, the method comprising measuring the microwave energy reflected by the load, and, when a given level of reflected microwave energy is exceeded, adjusting two tuning members with one of the tuning members having a higher adjustment speed than the other.

If, when the reflected microwave energy is measured, it is found that an admissible level has been exceeded, the tuning members are adjusted at different speeds until the microwave installation is again tuned to such an extent that the reflected microwave energy is reduced to the desired minimum.

Advantageously, one tuning member is adjusted repeatedly through the entire tuning range, while the second tuning member is adjusted only through a partial range. While the second tuning member passes through its tuning range or a part thereof, the first tuning member may pass through its full tuning range several times, for example 30 times. In this way, the matching process continuously effects minimization of the reflected microwave energy. When the minimum of reflected microwave energy is reached, adjustment of the tuning members is stopped.

Such a method can have the important advantage of providing a matching process which is convergent in any load range.

According to another aspect of the invention, there is provided a microwave heater including matching means for reducing the microwave energy reflected by the load and comprising a treatment chamber connected to a microwave generator by way of a hollow waveguide of substantially square or rectangular cross-section, displaceable tuning pins disposed in the hollow waveguide, a circulator or directional coupler which blocks, from the microwave generator, the microwave energy reflected by the load, and leads to absorption means, measuring means for the reflected microwave energy disposed at the absorption means, switching means for converting the measured value into a proportional electrical signal and connected to the output of the measuring means, and an amplifier circuit to compare the electrical signal with a desired value to produce an output signal which is applied to control members for actuating control motors of the tuning pins, the control motors having different speeds.

Advantageously, the control motors are connected to the tuning members by way of crank transmission means.

When the reflected microwave energy deviates from a predetermined minimum, the tuning pins are automatically displaced at different speeds until the measured reflected microwave energy has again been restored to the minimum value.

It is known that, with a three-part tuning transformer whose tuning members have $\lambda/4$-spacings, any defective matching of a microwave installation can be eliminated (Meinke/gunlach, 1968, page 420). If the predetermined minimum of reflected microwave energy cannot be attained by means of two tuning members, a third tuning member can carry out the same tuning process, with that one of the other tuning members which is at the $\lambda/4$-spacing. In this case, the tuning member which is at the $\lambda/2$-spacing is retracted into a starting position.

This mode of operation can ensure, after a double tuning period, that the installation is matched.

It is thus possible to provide for matching of a microwave system, wherein the useful power from the microwave generator is also applied almost entirely to the load, in operation of the microwave installation.

BRIEF DESCRIPTION OF THE APPLICATION DRAWINGS

The invention is diagrammatically illustrated by way of example in the accompanying drawings, in which.

DETAILED DESCRIPTION OF THE PREFERRED EMBODIMENTS

Figure 1:
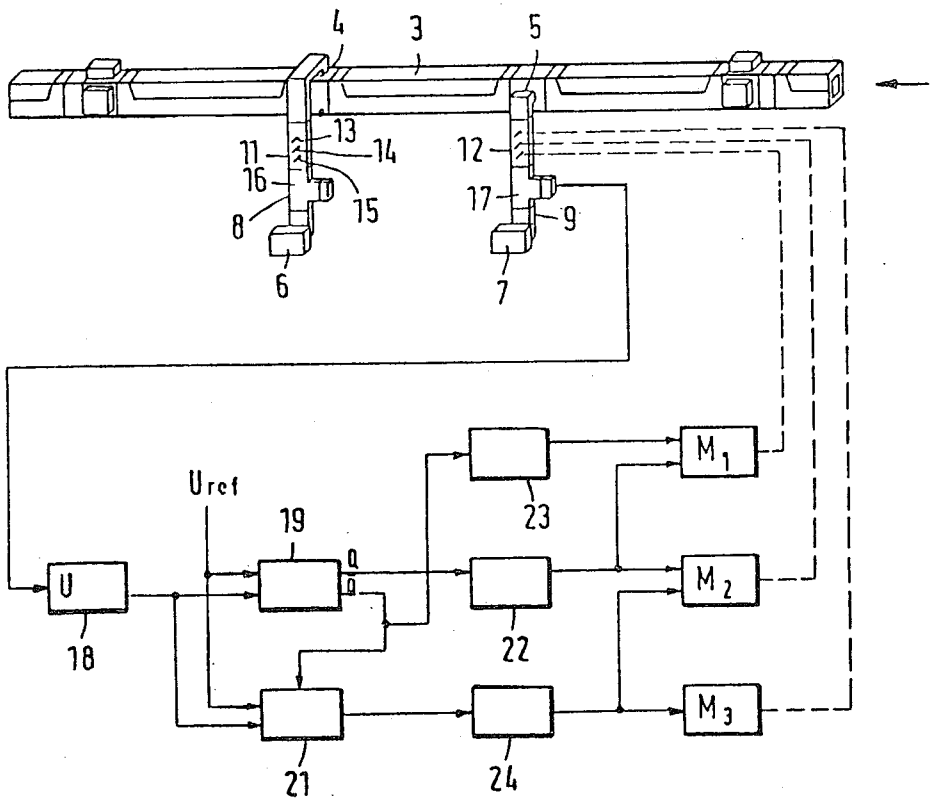
FIG. 1 shows a diagrammatic view of a microwave heater with control means for matching the microwave heater.

Referring to the drawings, and initially to FIG. 1, a treatment chamber of a microwave heater is formed with a microwave treatment passage 3 of approximately square cross-section. Elongated material to be heated, comprising, for example, rubber, is passed through the passage 3.

The microwave energy is introduced into the treatment chamber 3 at two coupling stations 4 and 5. Each coupling station 4 and 5 is connected to a respective microwave generator 6 and 7 by way of a respective hollow waveguide 8 and 9 of square cross-section. The waveguides 8 and 9 which terminate at the treatment chamber 3 are displaced at 90° relative to each other. The introduction of the microwave energy, at positions which are displaced through 90° relative to each other, causes the production of two $TE_{10}$-waves which are turned through 90°. In this way, there is a favorable energy absorption angle between the profile lip and the E-field line, for different profiles of the elongated material to be heated.

A matching transformer 11 and 12 is disposed at each of the waveguides 8 and 9 which carry the microwave energy, each such transformer comprising three tuning pins 13, 14 and 15. A directional coupler such as a circulator 16 and 17 is connected between the respective transformer 11 and 12 and the associated microwave genrator 6 and 7 and passes the microwave energy reflected by the load to an absorption means where the reflected microwave energy is consumed. The absorption means is provided with measuring means comprising an antenna and a detector probe 18. The probe is per se known, being a commercially available item sold by Weinschel Engineering, Gaithersburg, Md., 20760, U.S.A., and identified as coaxial crystal detector, Model 1112.

The arrangement described therefore produces an electrical signal U which is proportional to the reflected microwave energy and which is applied to two comparators 19 and 21. A reference signal U ref is also applied to each of the comparators 19 and 21 respectively. If the voltage U produced by the probe 18 exceeds the voltage U ref of the reference signal, a signal Q is applied by way of the first comparator 19 to control means 22 for control motors $M_1$ and $M_2$. The control motors $M_1$ and $M_2$ are each coupled to a respective tuning pin 15 and 14 preferably by crank transmission means. In operation, the tuning pin 14 is displaced in a high-speed mode and the tuning pin 15 is displaced only slowly by its control motor $M_1$.

If matching of the microwave installation has not been achieved within a given period of time, which period is determined by a timing member integrated in the comparator 19, a signal $\bar{Q}$ is used. This signal $\bar{Q}$ is applied to the second comparator 21 and to resetting means 23 for the motor $M_1$ of the tuning pin 15. The second comparator 21 applies a signal to control means 24 for the motor $M_2$ and a motor $M_3$ for the tuning pins 13 and 14 respectively. The tuning pins 13 and 14 carry out the same matching operation while the tuning pin 15 is returned to a starting position.

The control means 22 and 24, and the resetting means 23 preferably comprise relays which are per se known, being sold by Siemens, Munich, Germany, type number NV23154-c/B104. The tuning pins 13–15 are likewise known prior art, reference being to German Application No. DE-AS 26 42 335.

When the detector probe voltage and thus the reflected microwave energy fall below a predetermined level U min, the input signal to the comparators 19 and 21 falls below a switch-off threshold. The comparators 19 and 21 no longer produce an output signal for energizing the control motors. The microwave installation is thus matched for the operating condition at that time.

Figure 2:
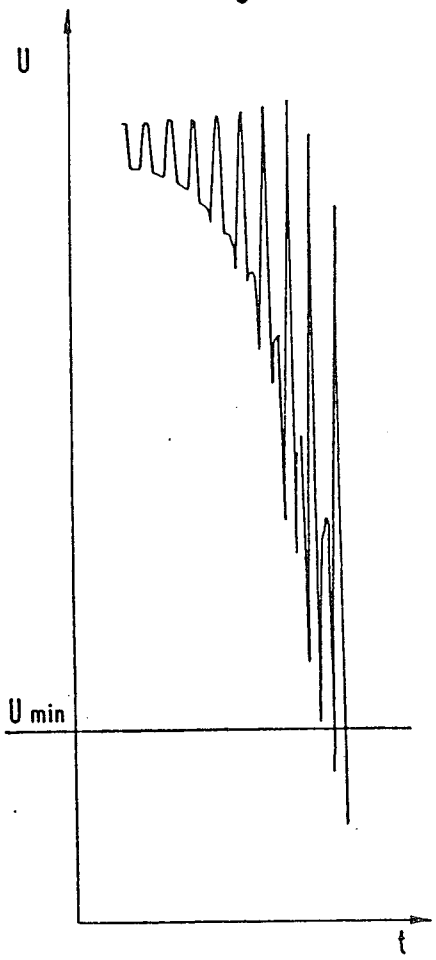
FIG. 2 shows the potential gradient of the detector probe which receives the reflected microwave energy, in automatic matching of the microwave heater.

FIG. 2 shows the potential gradient in respect of minimization of voltage and thus minimization of the reflected microwave energy. When using direct-current motors, it is possible that the high-speed mode of movement of the one tuning pin may cause the tuning pin to go beyond the minimum. The switching means in such a case can then be provided with a means which makes it possible for the tuning pin to be reversed in its setting. If the tuning pins are displaced by means of stepping motors, then the voltage will not pass through the minimum voltage value.

Figure 3:
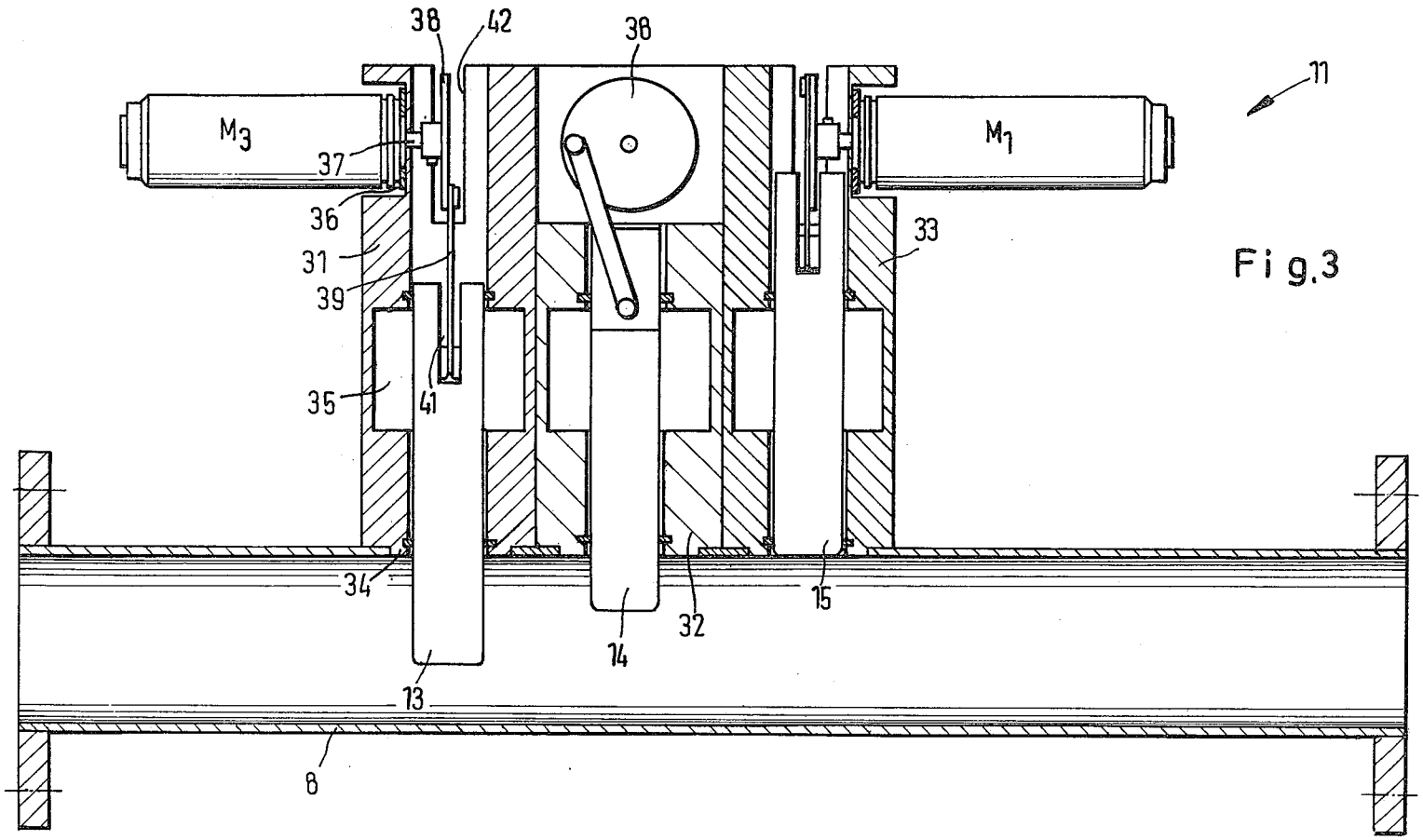
FIG. 3 is a vertical sectional view illustrating the tuning pins and their interconnections to the motors.

FIG. 3 is a sectional view showing the matching transformer 11 mounted adjacent the wave guide 8. Each of the tuning pins 13, 14 and 15 is arranged adjustably in a central bore of one of cylinder sleeves 31, 32 and 33, respectively. These sleeves 31, 32, 33 are formed with stepped center portions (34, cylinder 31) at their lower ends which fit into openings provided therefor in the wave guide 8, with the cylinder being securely mounted to the wave guide in any suitable manner.

The central bore of each cylinder 31, 32 and 33 which receives the pins 13, 14 and 15, respectively, includes a lower bore section which receives the lower end of the pin, an intermediate, radially enlarged bore section 35, and an upper bore section of similar diameter to the lower bore section. The length of the lower and upper bore sections are one quarter of its free wave length ($\lambda/4$), and the length of the intermediate, enlarged bore section, which constitutes an isolating space as in DE-AS No. 26 42 355, is similarly one quarter of the free wave length ($\lambda/4$). The pin 13 is shown fully extended into the wave guide; the pin 14 approximately half extended, and the pin 15 is not extended at all.

Adjacent the upper end of the cylinder 31, a recess is formed in which a plate 36 is mounted. An electric gear motor $M_3$ is mounted on the plate, with the output shaft 37 of the motor extending through an opening in the plate and having secured at its outer end a disc 38. Eccentrically pivotally mounted on the disc is a connecting rod 39 the other end of which is pivotally mounted in a groove 41 formed in the top of the pin 13.

The cylinder 31 is formed with a groove 42 to receive the disc.

It will thus be seen that the pin 13 can be reciprocated by the motor $M_3$ between its fully extended position as shown, and a fully retracted position (pin 15, FIG. 3). The tuning pin units 14, 32 and 15,33 are constructed in the same manner, with cylinder 32 and pin 14 being positioned at 90° relative to the cylinders 32,33 and pins 14, 15, respectively.

The motors $M_1$, $M_2$ and $M_3$ for the tuning pins are commercially available electric gear motors, being sold by the company Dr. Fritz Faulhaber, Mozartstrasse, D-7036, Schonaich, West Germany, under type number 330/03/2 12. The low and high speed adjustments for the pins can be obtained by simply choosing different transmissions.

We claim:

1. A method of matching a microwave heater, for the purpose of reducing microwave energy reflected by the load wherein microwave energy is supplied to a treatment chamber from a microwave energy source by way of a hollow waveguide of substantially rectangular cross-section and matching is effected by means of adjustable tuning members which are disposed in said hollow waveguide, the method comprising measuring the microwave energy reflected by the load and, when a given level of reflected microwave energy is exceeded, adjusting two tuning members with one of the tuning members having a higher adjustment speed than the other.

2. The invention claimed in claim 1, wherein a first of said tuning members is adjusted repeatedly through its full tuning range, while a second of said tuning members is adjusted through only a part of its range.

3. A microwave heater including matching means for reducing the microwave energy reflected by the load and comprising a treatment chamber; a microwave generator; a hollow waveguide of substantially rectangular cross-section connecting said microwave generator to said treatment chamber, displaceable tuning pins disposed in said hollow waveguide; a directional coupler to block, from the microwave generator, the microwave energy reflected by the load; absorption means to absorb said reflected microwave energy directed to said absorption means by said directional coupler; measuring means, disposed at said absorption means, to measure said reflected microwave energy; switching means connected to the output of said measuring means to convert the measured value measured by said measuring means into a proportional electrical signal; an amplifier circuit to compare said electrical signal with a desired value and produce an output signal; control members to which said output signal is applied; and control motors for said tuning pins, said control motors being actuated by said control members and having different operating speeds.

4. The invention claimed in claim 3, further comprising crank transmission means connecting said control motors to said tuning pins.

* * * * *